United States Patent [19]

Fox et al.

[11] Patent Number: 4,716,056

[45] Date of Patent: Dec. 29, 1987

[54] SYSTEM FOR TREATING A SURFACE

[76] Inventors: Frank Fox, 52A Robins Ave., Newington, Conn. 06111; Cassius W. Leys, 80 E. Hartsdale Ave., Hartsdale, N.Y. 10530

[21] Appl. No.: 945,887

[22] Filed: Dec. 24, 1986

[51] Int. Cl.[4] ..... B05D 3/02

[52] U.S. Cl. ..... 427/407.1; 427/386; 427/410; 427/140

[58] Field of Search ..... 427/386, 410, 407.1, 427/140; 428/413

[56] References Cited

U.S. PATENT DOCUMENTS

| | | | |
|---|---|---|---|
| 3,456,148 | 12/1970 | Diamond et al. | 427/385.5 |
| 4,169,088 | 9/1979 | Hansen | 427/154 |
| 4,349,586 | 9/1982 | Sejournant | 427/154 |
| 4,353,745 | 10/1982 | Ebbler | 427/154 |
| 4,428,994 | 1/1984 | Rawlins | 427/260 |
| 4,436,772 | 3/1984 | Yanabe et al. | 427/385.5 |
| 4,459,329 | 7/1984 | Watchko | 427/393.6 |

*Primary Examiner*—Thurman K. Page
*Assistant Examiner*—L. R. Horne
*Attorney, Agent, or Firm*—Grimes & Battersby

[57] ABSTRACT

A system and method are provided for treating a surface to both cover existing graffiti thereon and to facilitate removal of subsequently applied graffiti. A two part, water-based epoxy is initially applied to the surface. After drying thereof, a top coat system including an aliphatic urethane color component, a catalyst and a hardner is applied directly over the epoxy and permitted to dry. Upon drying, subsequently applied graffiti may be easily removed by the use of a solvenated cleaner.

18 Claims, No Drawings

SYSTEM FOR TREATING A SURFACE

BACKGROUND OF THE INVENTION

The present invention relates generally to a system for treating a surface and, more particularly, to such a system which includes a method and composition to treat such surface to render it substantially resistant to subsequent markings and to permit it to be readily and inexpensively cleaned using a particular cleaning composition without altering the surface or causing damage to any area in close proximity thereto.

In recent years there has been an increased concern over the rapidly growing problem of graffiti, particularly in urban areas. In modern times, the term graffiti has come to acquire a meaning which differs substantially from its historical meaning. The modern observer views graffiti not as an art form, but rather, as a form of destruction and vandalism.

The application of graffiti has become most prevalent in institutions, such as, schools, public and private buildings, automobiles, trucks, train cars and rest rooms which are available to the public at large. Graffiti is even more problematic in open areas, such as, support walls for bridges, the exterior walls of buildings, various structures in parks, which incidentally were put there in the first place to cosmetically improve the parks, and the like. The vast majority of such graffiti are oil based paints including enamels, epoxies, lacquers and urethanes, which are applied by spray cans.

The methods for the removal of graffiti, which are for the most part cost prohibitive, have heretofore included, sandblasting the surfaces on which the graffiti appears. This method often involves a subsequent repainting of the surface in order to restore its aesthetically pleasing appearance. Depending on the nature of the surface, such a method could have a potentially deleterious effect to the surface, as well as to any area in close proximity, because of the emission of potentially carcinogenic particles into the air. Moreover, the use of such a method does not provide for any long-term solution, since the surface will, no doubt, again become covered with new graffiti.

Another method which has been used for graffiti removal includes chemical treatment of the surface on which the graffiti appears. This method has proven equally unsuccessful. It has been found that repetitive chemical cleaning treatment quickly destroys the painted surface, necessitating frequent repainting. The application of such strong chemical cleaners also have a deleterious effect to the surrounding environment and on the person applying the chemicals.

Perhaps the most common way of removing graffiti is to repaint the surface and hope that the same individuals who had applied the original graffiti do not take the repainting as an invitation to refine their art skills. As can be appreciated, this approach is perhaps the least effective. It requires the use of a paint which is capable of covering the graffiti or the graffiti will bleed through the overcoat in a relatively short period of time.

Against the foregoing background, it is a primary object of the present invention to provide a system for treating a surface to thereby render it substantially resistant to the subsequent application of graffiti and facilitate the removal thereof.

It is another object of the present invention to provide such a system which includes a method and composition to the surface to both cover any graffiti previously applied thereto and to facilitate subsequent cleaning thereof.

It is still another object of the present invention to provide such a system which includes a cleaning composition for subsequent cleaning of graffiti from the surface.

SUMMARY OF THE INVENTION

To the accomplishments of the foregoing objects and advantages, the present invention, in brief summary, includes a system for treating a surface to both cover existing graffiti on the surface and to facilitate removal of subsequently applied graffiti. The system includes the use of a water based epoxy paint composition which is initially applied to the surface to cover any existing graffiti thereon. After drying thereof, an aliphatic urethane is applied to the surface and permitted to dry. Subsequent applications of graffiti can be removed using specialized formulations of cleaners which includes methyl ethyl ketone, methylene chloride, toluene and other solvents.

DESCRIPTION OF THE PREFERRED EMBODIMENTS

The system of the present invention is particularly adapted for use on most surfaces generally susceptible to the application of graffiti including, for example, masonry, wood and steel. Such masonry surfaces may include cement, cement blocks, concrete, brick, mortar and the like. The present system is particularly adaptable for use on steel structures such as bridges, buildings, highway underpasses and overpasses, statues walls and the like.

Depending on the condition of the surface to be treated, scraping, degreasing, brushing down, and/or light sanding may be required in order to enhance the adhesion or bonding of the undercoat to the surface. Thus, if cracks, splinters or loose pieces of debris such as, for instance, paint chips or the like, are present on the surface to be treated, it is preferable to remove them prior to application of the compositions of the present system. Additionally, if the surface has previously been painted a variety of times, it is preferable to "roughen up" the surface to enhance adhesion. Finally, even if the surface is in relatively good condition, the surface should be washed with water or a mild solvent to remove any dirt and grease which might affect bonding.

After surface preparation, an undercoat is applied to the surface to cover any existing graffiti and prevent any graffiti from bleeding through and to provide a solid undercoat for the subsequent application of a protective topcoat. It has been found that a particularly preferred undercoat is a water-based epoxy paint which is particularly effective in covering any existing graffiti and preventing bleed through. In virtually all instances, such water based epoxy paints do not chemically attack the surfaces to which they are applied nor the graffiti which may be found thereon. This is due to the fact that a water based epoxy paint is incapable of reacting with or softening the underlying graffiti which is typically solvent based paints. What has been found is that the water based epoxy paints tend to effectively seal in any graffiti found on such surfaces. This is in direct contrast with a solvent based epoxy paint which may tend to react with and otherwise dissolve the underlying graffiti.

A particularly preferred water based epoxy paint is a two part, water based epoxy paint system which includes an amine emulsion as the epoxy coating hardener and a diglycidyl ether of disphenol A emulsion as the epoxy resin coating. One example of such two part, water based epoxy paint system is the product Dur-A-Poxy 200, which is manufactured and distributed by Dur-A-Flex, Inc. Dur-A-Poxy 200 is a catalyzed, true epoxy which will not alter the surface to which it is applied, but rather, will seal the graffiti on the surface. It has been found that the use of a catalyzed epoxy provides a good coating with strong adhesion properties. The amine emulsion mixed with a catalyst serves to set up a permanent bond with the underlying surface. Another suitable water based epoxy paint is marketed by Glidden.

The properties of the water-based epoxy paint employed should be such that the graffiti it covers will not, as time passes, "bleed through". That is to say, the underlying graffiti will not react with, lift off, or penetrate the undercoat as time passes. It becomes encapsulated with the prime coat.

The component parts of the undercoat should be mixed together immediately before application to the surface to be coated in equal amounts. The undercoat may be applied to the surface by conventional application means, i.e., by the use of a roller or brush or by spraying it on. A particularly preferred means of application is by the use of a sprayer as that permits a faster and more even application.

The undercoat, which is preferably applied to a thickness of between about 0.002 and about 0.003 inches, may, in certain instances, be diluted by the addition of up to about 10% water for ease of application. At such thickness, one gallon of undercoat will typically cover about 200 square feet of surface area although this will vary greatly as a function of the surface being covered. For example, more porous surfaces such as concrete and the like will tend to absorb greater amounts of undercoat than less porous surfaces such as steel and other metals.

Whether or not the undercoat is actually diluted depends in large measure upon the vehicle used for application. One advantage of diluting the undercoat is that is has been found to increase its pot life.

After application, the undercoat is permitted to dry for a period of at least about four (4) hours and, preferably for at least about eight (8) hours to permit release of any moisture which may be contained in the undercoat.

After drying, a top coat system is then applied to the surface over the undercoat. A preferred top coat includes a mixture of a color coat of an aliphatic polyester urethane, an enamel catalyst; a hardener, preferably a quaternary ammonium hardener; an accelerator; and a reduction agent which are admixed together immediately prior to application to the substrate.

A particularly preferred color coat is a fully cross-linked polyurethane color coat such as, for example, the polyurethane color coat marketed by the Ditzler division of PPG Industries, Inc. under the mark "Durethane". A particularly preferred enamel catalyst is the enamel catalyst marketed by Ditzler under the "Durethane" mark.

A particularly preferred hardener is an isocyanate hardener of the type which is marketed by PPG Industries under the trade designation DXV-789. The hardener further improves the resistance of the top coat to cleaning off subsequently applied graffiti. The hardener also serves to provide a relatively hard, impervious surface which may be readily cleaned after application using the cleaners provided in the system.

Accelerators such as, for example, DXR-81 marketed by PPG Industries, may also be included in the top coat system for accelerating or otherwise increasing the cure time.

The above recited components are admixed immediately prior to application and then thinned or otherwise reduced using a reducer or thinner, preferably the reducer marketed by Ditzler under the "Durethane" mark.

It will be appreciated that the amount of each component portion of the top coat system will vary depending upon the particular application. In a preferred embodiment, however, the top coat system includes the following components in the following amounts:

| Component | Amount |
|---|---|
| Polyurethane Color Coat | 1 gallon |
| Catalyst | 1 gallon |
| Hardener | 5 oz. |
| Accelerator | 2 oz |
| Thinner | 0.5-1 gallon |
| other additives | to desired amount |

The top coat may be applied to the surface over the undercoat by conventional application means, i.e., by the use of a roller, brush or by spray gun. A particularly preferred means of application is by the use of a spray gun as that permits a faster and more even application.

The top coat, which is preferably applied to a thickness of between about 0.002" and about 0.004", may, in certain instances, be diluted with a solvent for ease of application. At such thickness, one gallon of top coat will typically cover about 400 square feet of surface area. It has been found that that application of the undercoat provides a strong and even surface for accepting the subsequent application of the top coat.

The extent to which the top coat is diluted is determined by the method of application employed. In those instances where the top coat is sprayed on, it may be diluted with a suitable solvent in a ratio of between about 4:1 and about 8:1 of solvent to paint.

In a preferred embodiment, two relatively thin coats of the top coat is applied in serium, i.e., the second coat of the top coat is applied over the first coat before the first coat is permitted to dry. The total thickness of the top coat should be between about 0.002" and about 0.004". A preferred thickness is about 0.002".

After application and drying of the top coat, the surface is now ready to be used in normal fashion. In those instances where subsequent cleaning of fresh graffiti is required, it has been found that the surface provided by the urethane top coat may be easily cleaned with a cleaner which includes an active ingredient including toluene, methyl ethyl ketone, xylene, methylene chlorider, methanol, acetone, methyl chloroform, ethylene glycol, n-butyl ether, and propane.

A cleaner, which is particularly adaptable for removal of graffiti typically applied by various spray paints, contains the following ingredients:

| Ingredient | Percent By Wgt. |
|---|---|
| toluene | 28% |
| methyl ethyl ketone | 10% |

-continued

| Ingredient | Percent By Wgt. |
|---|---|
| xylene | 13% |
| ethylene glycol n-butyl ether | 2% |
| methylene chloride | 10% |
| propane | 15% |
| isopropanol | 15% |
| methanol | 2% |
| o-Dichlorobenzene | 5% |

Other non-toxic cleaners can be used for the removal of spray paints, marking inks, crayons, lipstick, road tar, stencil inks and other solvent and oil base stains.

Such cleaners are applied in the typical fashion by application onto the graffiti on the surface using rollers, brushes or by spraying. After allowing the active ingredients in the cleaner to act on the graffiti, the cleaner with the underlying graffiti is easily removed. It has been found that such cleaners are effective in removing most, if not all, of the types of graffiti being applied to surfaces without attacking the underlying surface coating.

The following examples serve to illustrate certain preferred forms of the present invention.

EXAMPLE 1

The system of the present invention was used to solve a graffiti problem on a bridge underpass fabricated from pre-cast concrete. The wall was initially cleaned using a standard floor broom. A water-based epoxy undercoat was applied to an area of the wall eight feet high and fifty feet wide. The two part components of the epoxy undercoat were mixed together in equal amounts and the undercoat was brushed onto the wall to a thickness of 0.002".

The undercoat was permitted to dry for a period of 24 hours. An aliphatic urethane top coat system was thereupon applied over the undercoat by spraying. Initially, a thin first coat was applied followed by a second thin coat. The composite thickness of both coats was approximately 0.002".

The resultant wall was generally impervious to subsequent application of graffiti and any subsequently applied graffiti was easily removed using one or more of the above described cleaners.

EXAMPLE 2

The instant system was also used on metal bathroom partitions which were 85% to 90% covered with graffiti. Most of the graffiti applied were enamels, epoxies, lacquers and urethanes.

The surface was precleaned and the same system used in Example 1 was applied in generally the same manner. After application of the topcoat, the underlying graffiti did not "bleed through" and any subsequent markings which have been placed onto the surface of the partition have been successfully removed using the cleaners identified above.

EXAMPLE 3

The system of the present invention was tested on an 8' by 10' section of a bandstand wall which was in generally poor condition due to the numerous coats of paint which had been applied to it and moreover, because of the many years that it had been standing. The wall was lightly scraped in an effort to remove the looser pieces.

The same components of Example 1 were applied in the same manner as identified in that Example. The treatment of the wall not only cosmetically improved its overall appearance but, moreover, any graffiti which had subsequently been placed on the treated surface was successfully removed.

Having thus described the invention with particular reference to the preferred forms thereof, it will be obvious that various changes and modifications may be made therein without departing from the spirit and scope of the invention as defined by the appended claims.

Wherefore, we claim:

1. A method for treating a surface to facilitate subsequent removal of any markings placed thereon, said method comprising the steps of:

preparing by scraping, degreasing, brushing, sanding and/or washing said surface;

applying a water-based epoxy to said surface and permitting said water-based epoxy to dry for a period sufficient to allow the release of any moisture contained therein; and applying a top coat which includes an aliphatic urethane color component to said surface and permitting said top coat to dry thereon.

2. The method of claim 1, wherein said water-based epoxy is a two part mixture including an epoxy coating hardener and an epoxy resin coating and wherein said method includes the step of pre-mixing said epoxy coating hardener with an epoxy resin coating prior to application onto said surface.

3. The method of claim 2, wherein said epoxy coating hardener is an amine emulsion.

4. The method of claim 3, wherein said epoxy resin coating is a diglycidyl ether of bisphenol A emulsion.

5. The method of claim 1, wherein said water-based epoxy is diluted prior to application with water in a ration of between about 10:1 to about 20:1 of water to epoxy.

6. The method of claim 1, wherein said top coat includes the following components: an aliphatic urethane color component, a catalyst, a hardener, an accelerator, and a reducer and which said method includes the step pre-mixing said components prior to application of said top coat to said surface.

7. The method of claim 6, wherein said top coat is applied in a series of coats with each coat being applied over the previous coat prior to drying thereof.

8. The method of claim 1, wherein said water-based epoxy and said top coat are applied to the surface by spraying.

9. The method of claim 1, wherein said water-based epoxy and said top coat are applied to the surface using a roller.

10. The method of claim 1, wherein said water-based epoxy and said top coat are applied to the surface using a brush.

11. The method of claim 1, wherein said water-based epoxy is applied to the surface at a thickness of between about 0.002" and about 0.003".

12. The method of claim 1, wherein said top coat is applied to the surface at a thickness of between about 0.002" and about 0.004".

13. The method of claim 1, further comprising the step of cleaning subsequently applied graffiti from said surface by the use of a solvenated cleaner including at least one active ingredient selected from the group consisting of toluene, methyl ethyl ketone, xylene, methylene chloride, methanol, acetone, methyl chloroform, ethylene glycol, n-butyl ether, and propane.

14. A system for treating a surface to cover existing graffiti thereon and to facilitate removal of subsequently applied graffiti, said system including:

a two part, water based epoxy paint including an epoxy coating hardener and an epoxy resin coating adapted to be applied to a surface containing existing graffiti; and a aliphatic urethane top coat system including a urethane color component, a catalyst, a hardener and a reducer which is adapted to be applied to said surface over said epoxy paint after drying thereof.

15. The system of claim 14, wherein said epoxy coating hardener is an amine emulsion.

16. The system of claim 14, wherein said epoxy resin coating is a diglycidyl ether of bisphenol A emulsion.

17. The system of claim 14, wherein said urethane color coating is a fully cross-linked polyurethane material.

18. The system of claim 14, further including a solvenated cleaner adapted to be used for cleaning subsequently applied graffiti from said surface, said cleaner having an active ingredient selected from the group consisting of toluene, methyl ethyl ketone, xylene, methylene chloride, methanol, acetone, methyl chloroform, ethylene glycol n-butyl ether and propane.

* * * * *